US007900999B2

(12) United States Patent
Reynolds et al.

(10) Patent No.: US 7,900,999 B2
(45) Date of Patent: Mar. 8, 2011

(54) CONVERTIBLE SEAT WITH AIR MATTRESS

(75) Inventors: Clifton D. Reynolds, LaGrange, IN (US); Perry A. Nichols, Elkhart, IN (US)

(73) Assignee: MC Marketing Resources, LLC, LaGrange, IN (US)

( * ) Notice: Subject to any disclaimer, the term of this patent is extended or adjusted under 35 U.S.C. 154(b) by 344 days.

(21) Appl. No.: 11/952,304

(22) Filed: Dec. 7, 2007

(65) Prior Publication Data

US 2009/0146469 A1 Jun. 11, 2009

(51) Int. Cl.
*A47C 17/32* (2006.01)

(52) U.S. Cl. ..... 297/118; 5/29

(58) Field of Classification Search ..... 297/118; 5/29, 44.1, 38, 32.1
See application file for complete search history.

(56) References Cited

U.S. PATENT DOCUMENTS

| | | | | |
|---|---|---|---|---|
| 324,583 | A | | 8/1885 | Okey |
| 579,425 | A | | 3/1897 | Collins |
| 2,126,588 | A | | 8/1938 | Thum |
| 2,615,502 | A | | 10/1952 | Schneider |
| 3,656,189 | A | | 4/1972 | Wiberg |
| 3,902,759 | A | | 9/1975 | Monteforte et al. |
| 4,442,556 | A | | 4/1984 | Craigie |
| 4,694,515 | A | * | 9/1987 | Rogers, Jr. ..... 5/13 X |
| 5,107,553 | A | * | 4/1992 | Mizrahi ..... 5/29 X |
| 5,787,522 | A | | 8/1998 | Swihart |
| 6,082,805 | A | | 7/2000 | Gray et al. |
| 6,651,274 | B2 | | 11/2003 | Swihart et al. |
| 6,857,142 | B2 | | 2/2005 | Fruge |
| 7,188,379 | B2 | | 3/2007 | James et al. |
| 2004/0073999 | A1 | | 4/2004 | Fruge |
| 2006/0096027 | A1 | | 5/2006 | Thurow |
| 2006/0179566 | A1 | | 8/2006 | James et al. |
| 2008/0066227 | A1 | | 3/2008 | James et al. |
| 2008/0098518 | A1 | | 5/2008 | Arft |

* cited by examiner

*Primary Examiner* — Anthony D Barfield
(74) *Attorney, Agent, or Firm* — Hahn Loeser & Parks LLP

(57) ABSTRACT

A convertible seat that has both a seat and bed position. The convertible seat includes a stationary bed section and folding bed section that pivots relative to the stationary bed section. The folding bed section serves as the seating surface when the seat is in the seat position and the foot end of the bed when the seat is in the bed position. An air mattress is located between the stationary bed section and folding bed section when the seat is in the seat position. Inflation of the air mattress causes the folding bed section to pivot outward to create the bed position.

12 Claims, 9 Drawing Sheets

CONVERTIBLE SEAT WITH AIR MATTRESS

BACKGROUND OF THE INVENTION

This invention relates to a seat with a section that pivots to form a bed.

SUMMARY OF THE INVENTION

The invention is directed to a convertible seat that converts between a seat position and bed position. The convertible seat has back cushions, seat cushions, armrests, a folding frame, and an air mattress. The folding frame includes a stationary bed section and a folding bed section that folds relative to the stationary bed section. While in a seat position, the folding bed section is positioned above the stationary bed section and the air mattress is located between the two sections. To achieve the bed position, the folding bed section is pivoted outward to form a bed surface. The air mattress is inflated to achieve a sleeping surface. Inflating the air mattress can be used to automatically deploy the folding frame from the seat position to the bed position. The stationary bed section can also slide or elongate to increase the sleep surface. Attached to the folding bed section is a support that supports a back cushion while in the seat position and supports the end of the folding bed section while in the bed position. The support can also re-orient to achieve the proper dimensions for the two functions.

BRIEF DESCRIPTION OF THE DRAWINGS

The drawing figures illustrate seven forms of the present invention, in which.

DESCRIPTION OF EXAMPLES EMBODYING THE BEST MODE OF THE INVENTION

Figure 1:
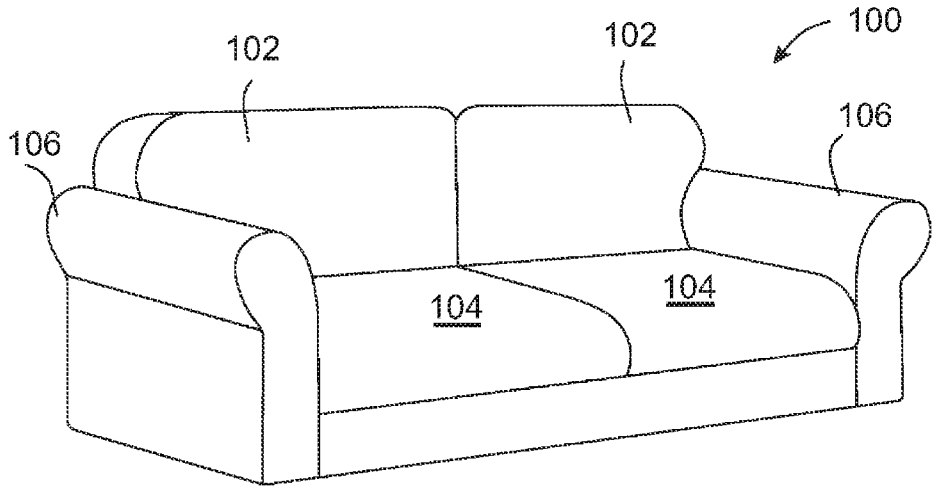
FIG. 1 illustrates a first embodiment of a convertible seat in the seat position.
Figure 2:
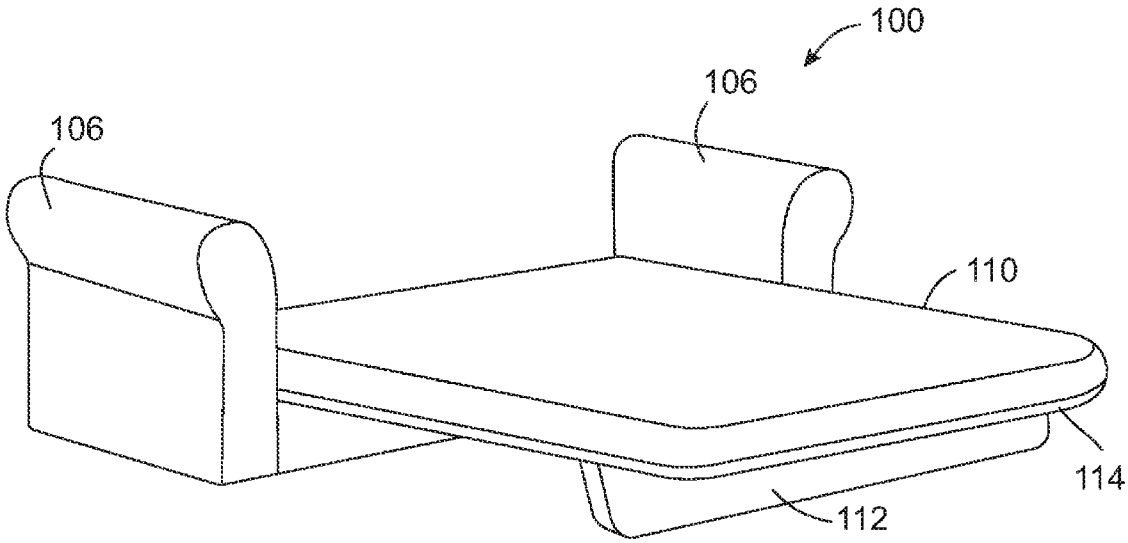
FIG. 2 illustrates the first embodiment of the convertible seat in the bed position.

A convertible seat 100 according to a first embodiment of the invention is shown in a seat position in FIG. 1 and deployed in a bed position in FIG. 2. The convertible seat 100 includes back cushions 102, seat cushions 104, armrests 106, a folding frame 108 between the armrests 106, and a mattress 110.

Figure 3:
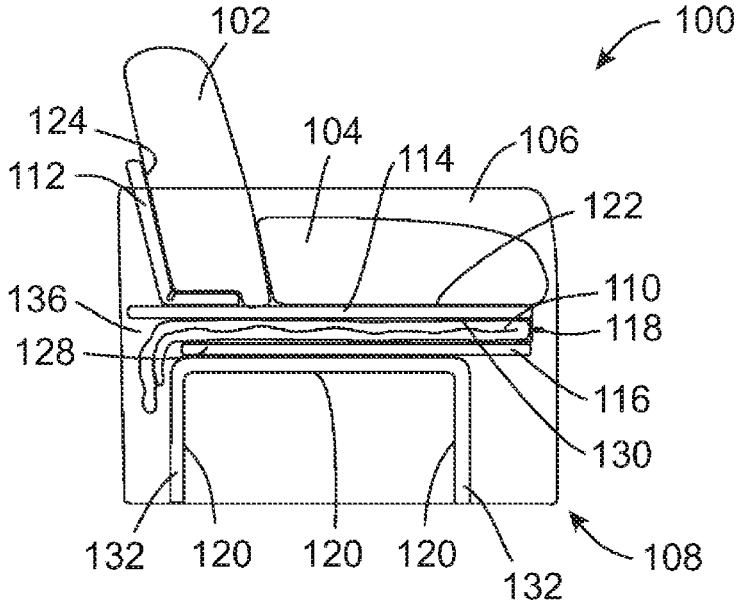
FIG. 3 is a side view taken of the convertible seat of FIG. 1 with the armrest removed.

FIG. 3 shows a cross sectional view of the convertible seat 100 in the seat position, revealing the folding frame 108. The folding frame 108 includes a support 112 which also serves as a leg when the invention is deployed in the bed position, folding bed section 114, stationary bed section 116, hinge 118, and base 120. The stationary bed section 116 is appropriately connected to the top of the base 120 in a conventional fashion (not illustrated), the hinge 118 connects the stationary bed section 116 and folding bed section 114, and the support 112 extends upward from the folding bed section 114. The seat cushions 104 are removable and rest on a seat surface 122 of the folding bed section 114 and the back cushions 102 and are also removable and rest against a back surface 124 of the support 112. FIG. 3 also shows the deflated air mattress 110 between the folding bed section 114 and stationary bed section 116.

Figure 4:
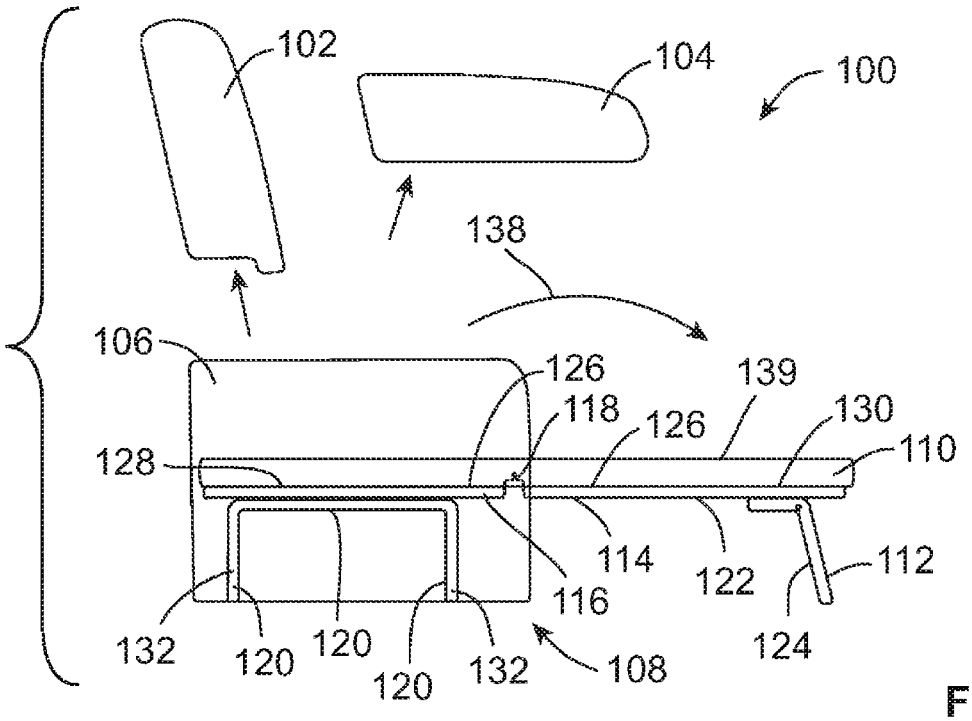
FIG. 4 is a side view taken of the convertible seat of FIG. 2 with the armrest removed, and showing the removal of the seat and back cushions during deployment.
Figure 5:
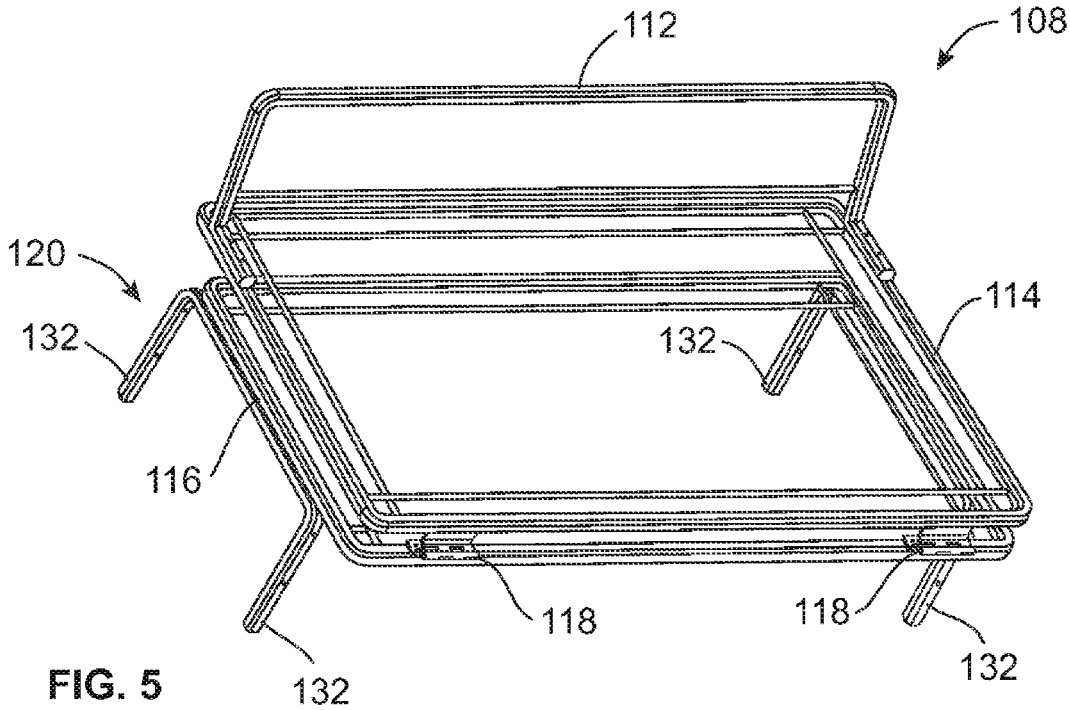
FIG. 5 is an isometric view of the folding frame of the first embodiment of the convertible seat in the seat position.
Figure 6:
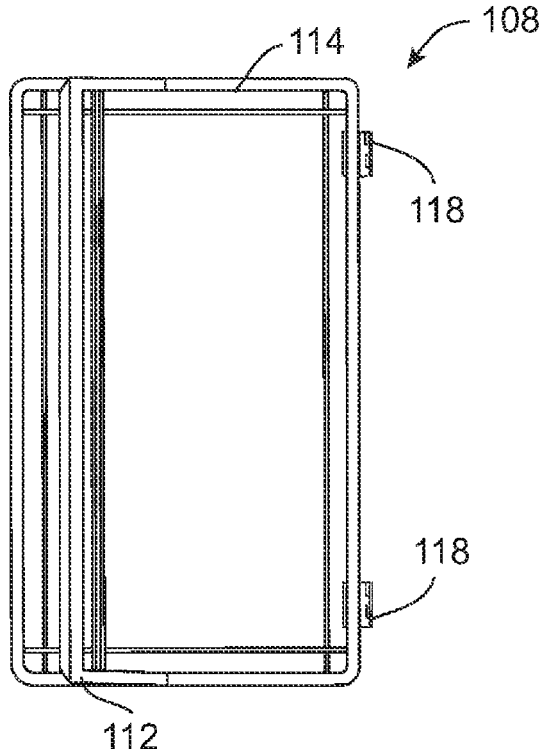
FIG. 6 is a top plan view of the folding frame of the first embodiment of the convertible seat in the seat position.

FIG. 4 shows the invention in the bed position. The back cushions 102 and seat cushions 104 have been removed. The folding bed section 114 has been pivoted outwardly in direction 138 about the hinge 118 to create a bed surface 126. The bed surface 126 includes a head end 128 on top of the stationary bed section 116 and a foot end 130 opposite the seat surface 122 on the folding bed section 114. The support 112 contacts the floor to serve as a support leg for the folding bed section 114. The air mattress is shown on top of the bed surface 126 and is appropriately inflated in a conventional fashion to form a sleep surface 139.

The inflation of the air mattress 110 can also be used to cause the folding bed section 114 to pivot or assist such pivoting. Additional support can be provided by the operator to the folding bed section 114 as it pivots to prevent it from abruptly landing. A spring mechanism (not illustrated) or other deployment aid can also be added to keep the folding bed section 114 from abruptly landing, or to assist in pivoting.

The folding frame 108 is shown in more detail in FIGS. 5-10 with the other components of the convertible seat 100 for ease of illustration. The base 120 is shown to include "U" shaped support legs 132 on either side. In another embodiment, "U" shaped support legs 132 are replaced by an established surface or other conventional support.

Figure 7:
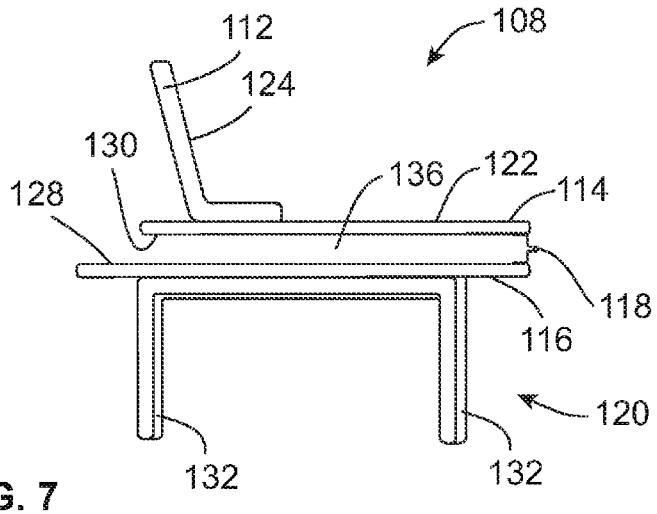
FIG. 7 is a side elevational view of the folding frame of the first embodiment of the convertible seat in the seat position.
Figure 8:
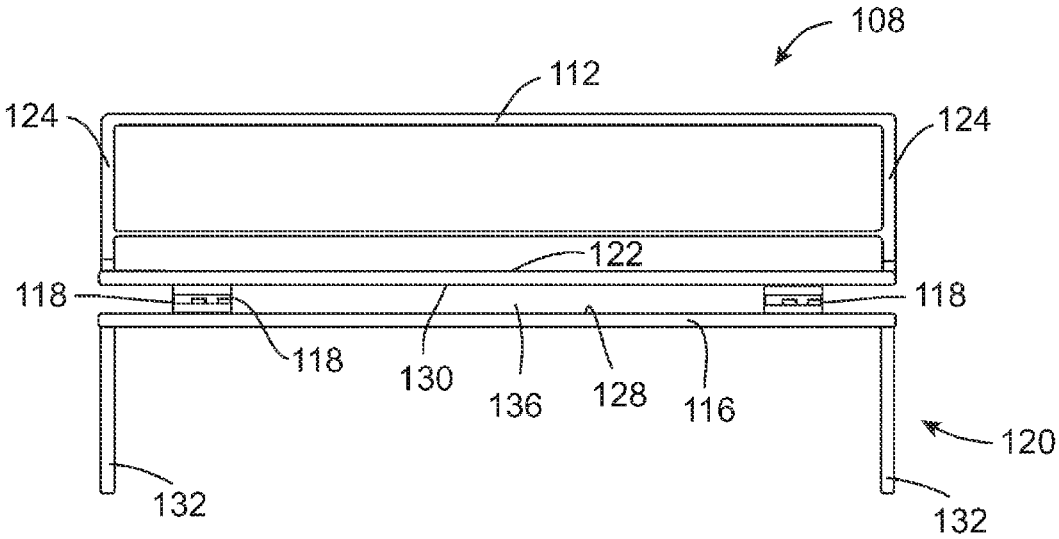
FIG. 8 is a front elevational view of the folding frame of the first embodiment of the convertible seat in the seat position.

FIG. 7 shows the head end 128 longer than the foot end 130. In another embodiment, as seen in FIG. 3, the foot end 130 is longer than the head end 128. The relative length of the head end 128 and foot end 130 can be varied to accommodate different mattress, motor, fill valve, release valve, and other equipment configurations.

In another embodiment (not shown), the support 112 and surface 124 is adjustable to account for taller or shorter individuals or cushion size to achieve a desired seat depth and back recline. The support 112 angle can be adjustable or the support can be repositioned along the foot end 130.

Figure 9:
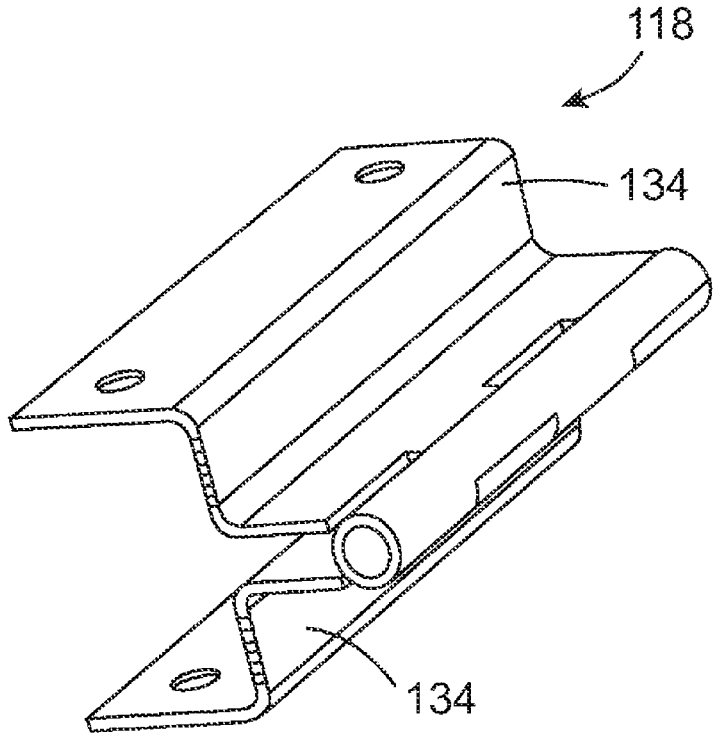
FIG. 9 is an isometric view of a hinge of the convertible seat.
Figure 10:
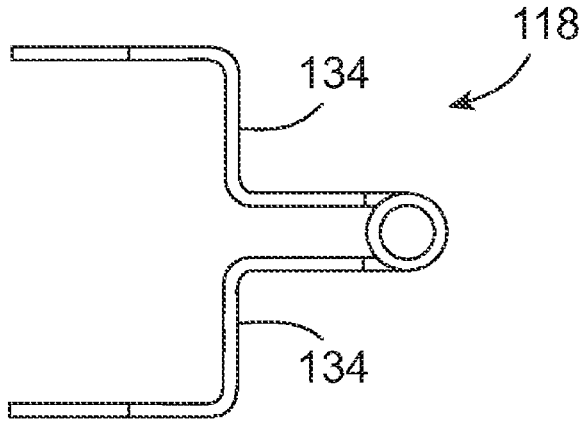
FIG. 10 is a side elevational view of the hinge of the convertible seat.

FIGS. 9 and 10 show the hinge 118 in greater detail. The hinge 118 includes perpendicular web sections 134 to create a cavity 136 (FIG. 3) between the folding bed section 114 and stationary bed section 116 in which to store or locate the mattress 110. Mattress 110 can also be stored or located in a cavity formed by a recess in the stationary bed section 116 or indent in the folding bed section 114 or both (not illustrated). The mattress 110 is pliable to create an even sleeping surface 139 despite an uneven bed surface 126 created by hinge 118 or other means of accommodating stored mattress 110.

A convertible seat 200 according to a second embodiment is shown in FIGS. 11-14. The convertible seat 200 includes an upper back cushion 202, a lower back cushion 204, a seat cushion 205, armrests 206, a folding mechanism 207, a base 210, and an air mattress 212.

The folding mechanism 207 includes a slide mechanism 208, a support 214, a folding bed section 216, a sliding bed section 218, stationary slide support 220, and hinge 222. The stationary slide support 220 is appropriately connected to the base 210 and the sliding bed section 218 is slidably engaged in the stationary slide support 220. The sliding bed section 218 slides relative to the stationary slide support 220 along grooves with the use of ball bearings or other conventional sliding mechanism which therefore is not shown in detail. Additional known mechanisms can also be used to elongate the bed.

As in the first embodiment of the invention, the hinge 222 connects the sliding bed section 218 and folding bed section 216, and the support 214 extends upward from the folding bed section 216. The deflated air mattress 212 lies between the folding bed section 216 and sliding bed section 218 in a cavity 236.

The upper back cushion 202 is connected to the back of the base 210 and the lower back cushion 204 is attached to a front back surface 224 of the support 214. Unlike the back cushions 102 of the first embodiment, the upper back cushion 202 and lower back cushion 204 may remain attached to the convertible seat 200 when converted to the bed position.

The seat cushion 205 is attached to a top seat surface 225 of the folding bed section 216. Unlike the seat cushions 104 of the first embodiment, the seat cushion 205 also may remain attached to the convertible seat 200 when converted to the bed position.

Figure 11:
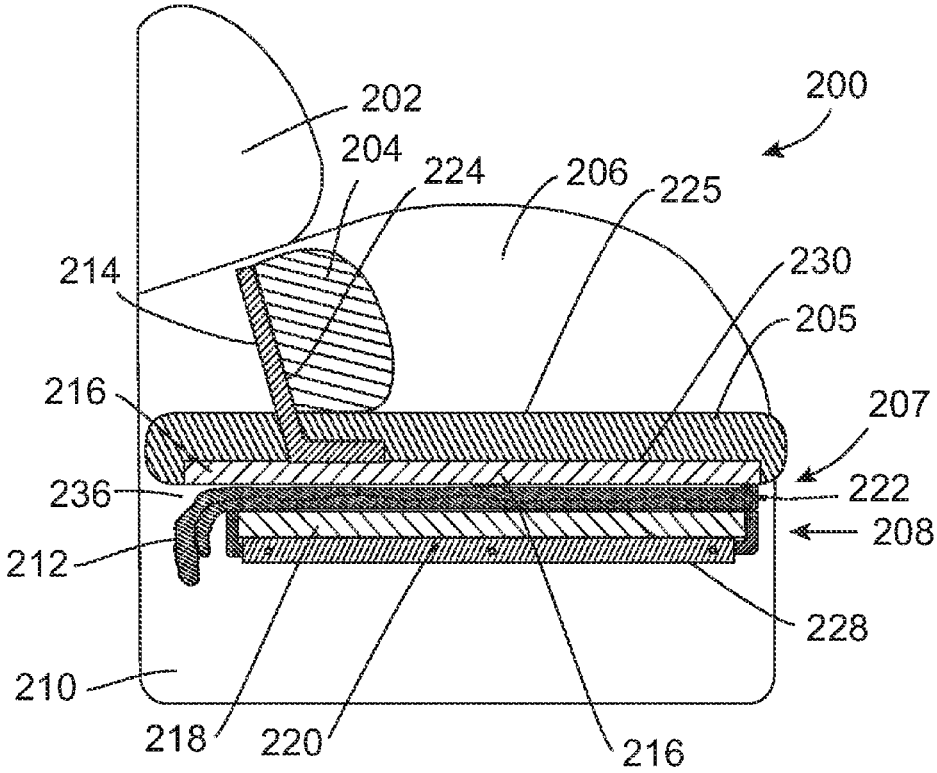
FIG. 11 is a cross-sectional view of a second embodiment of a convertible seat in the seat position.
Figure 12:
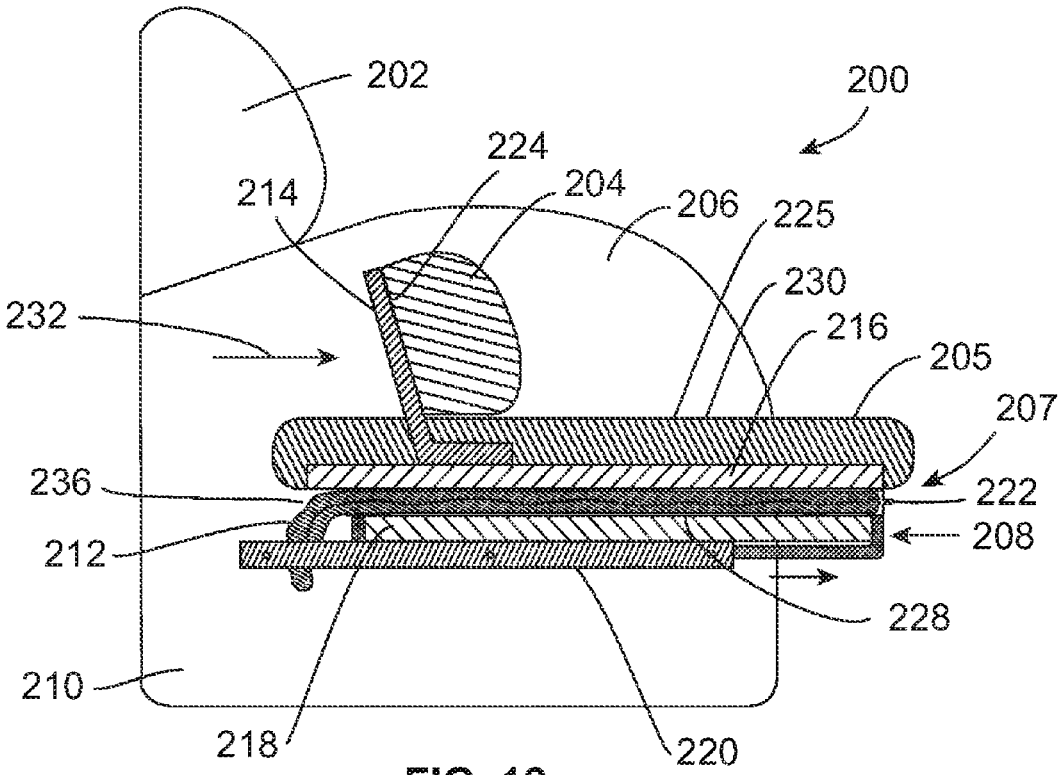
FIG. 12 is a cross-sectional view of the second embodiment of the convertible seat when initiating conversion between the seat position and bed position.
Figure 13:
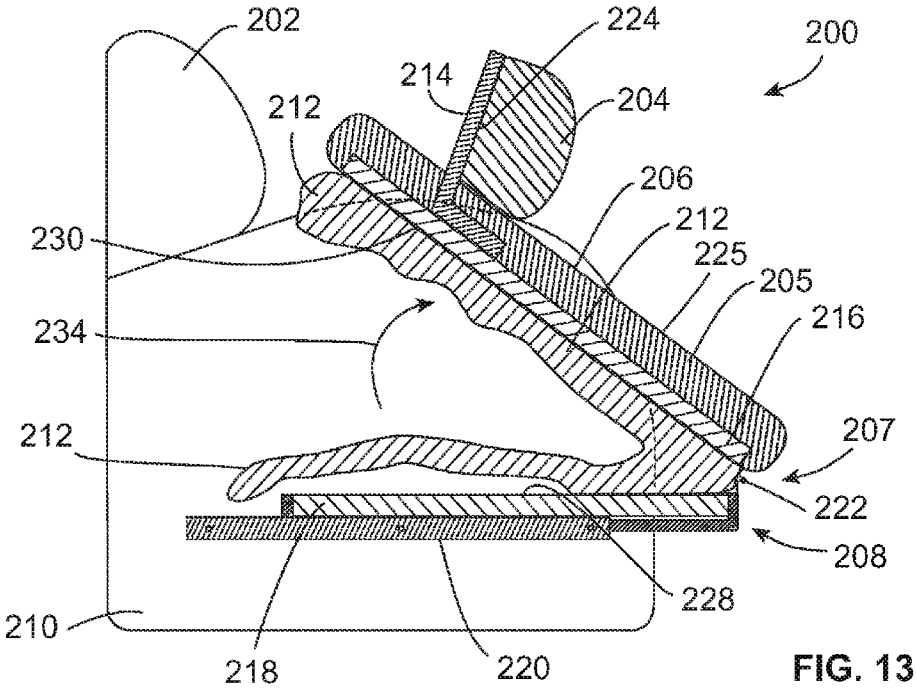
FIG. 13 is a cross-sectional view of the second embodiment of the convertible seat when continuing conversion between the seat position and bed position.
Figure 14:
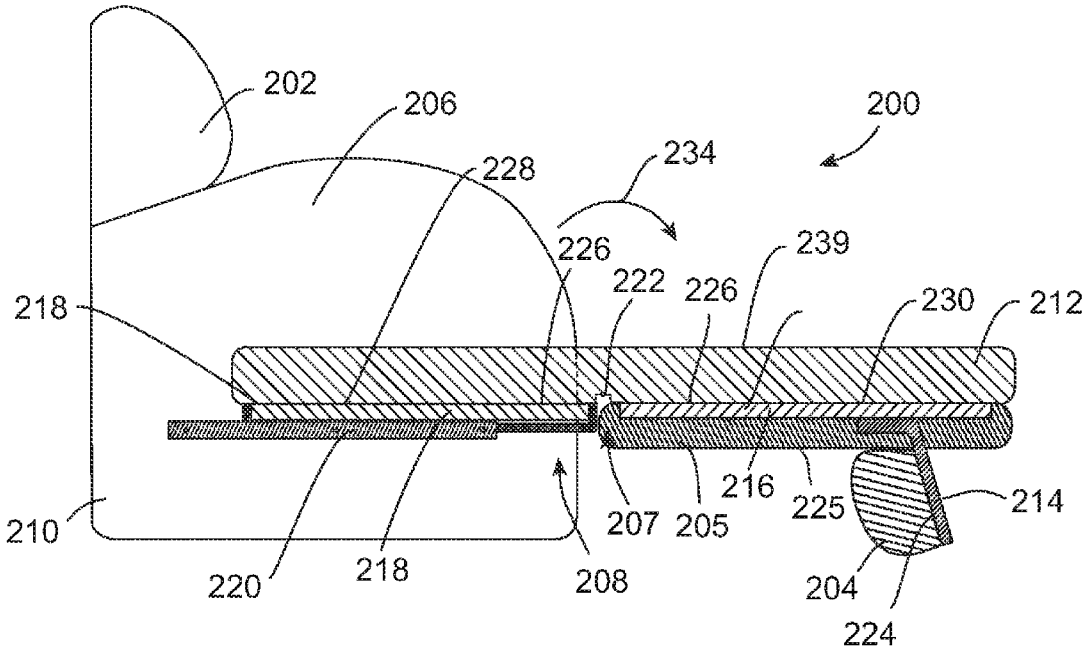
FIG. 14 is a cross-sectional view of the second embodiment of the convertible seat when deployed in the bed position.

FIGS. 11-14 show the conversion of the convertible seat 200 from a seat position shown in FIG. 11 to a bed position shown in FIG. 14. FIG. 12 shows a first step where the sliding bed section 218 is slid in a outward direction 232 relative to the stationary slide support 220. The sliding movement allows for a smaller front to back depth dimension of the base 210 while still accommodating a sleep surface 239 of seventy plus inches.

FIG. 13 shows the folding bed section 216 being pivoted in an outward direction 234 about the hinge 222. FIG. 13 also shows the air mattress 212 partially inflated and assisting in the pivoting of the folding bed section 216. In FIG. 14 the folding bed section 216 fully pivoted in outward direction 234, the support 214 contacts the floor and a bed surface 226 is formed. The bed surface 226 includes a head end 228 on top of the head sliding bed section 218 and a foot end 230 opposite the seat surface 225 on the folding bed section 216. FIG. 14 also shows the air mattress 212 fully inflated to create sleep surface 239.

Figure 15:
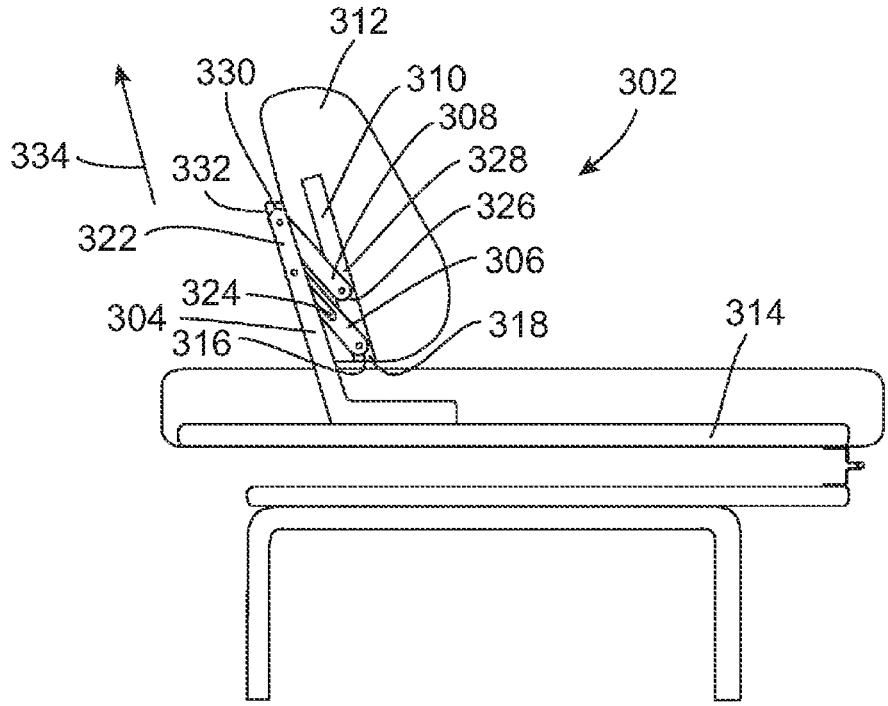
FIG. 15 is a side view of a third embodiment of the invention in the seat position.
Figure 16:
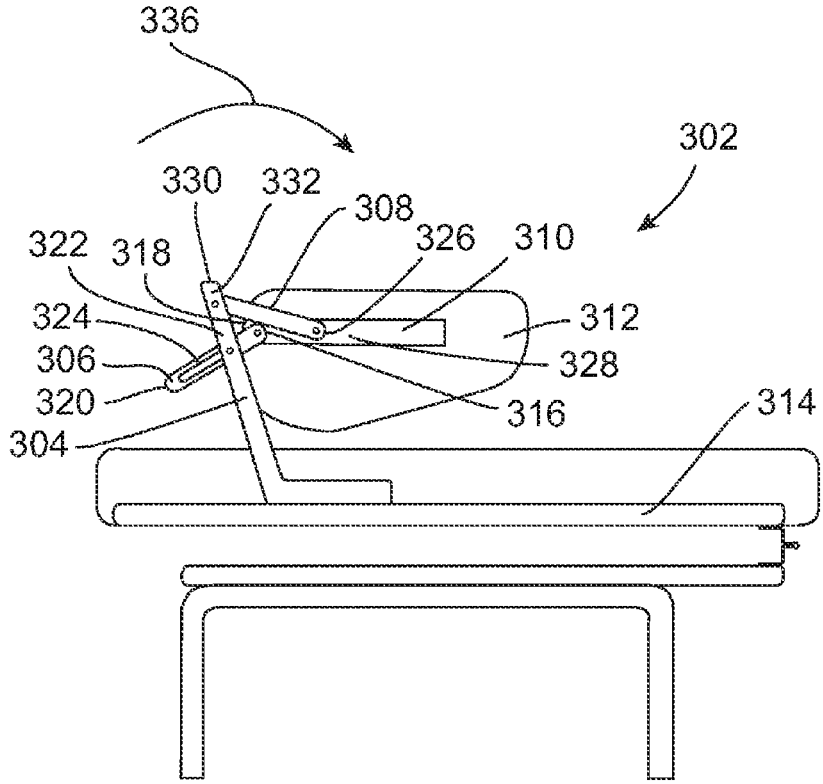
FIG. 16 is a side view of the third embodiment of the invention when converting between the seat position and bed position.
Figure 17:
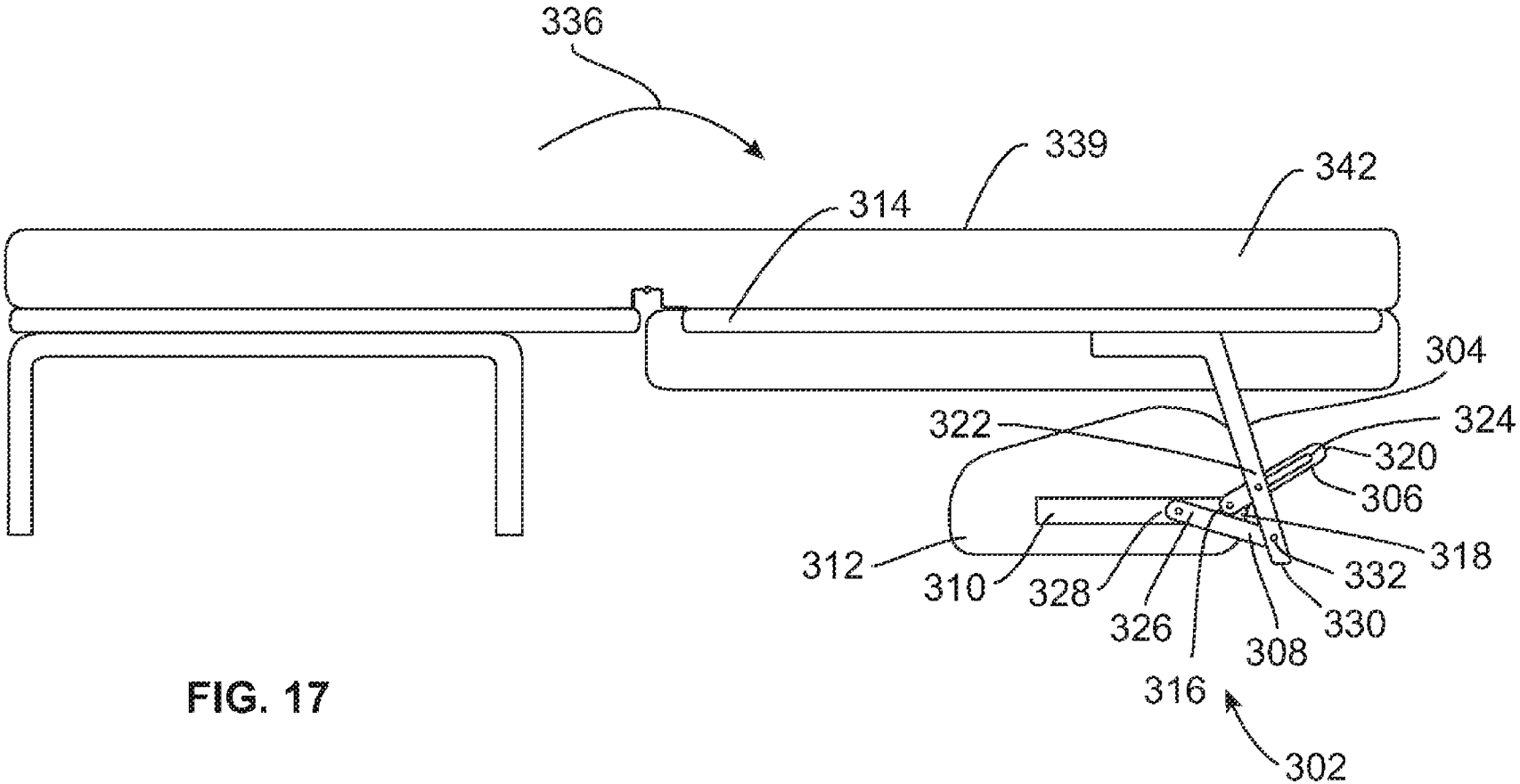
FIG. 17 is a side view of the third embodiment of the invention when deployed in the bed position.

FIGS. 15-17 show a re-orienting support 302 as an alternative to support 112 of the first embodiment or support 214 of the second embodiment. The re-orienting support 302 has a stationary support 304, sliding swing arm 306, pivoting swing arm 308, and a fixed support 310 for a permanently attached back cushion 312. The stationary support 304 is attached to stationary bed section 314.

One end 316 of the sliding swing arm 306 is pivotally attached to a bottom end 318 of the fixed support 310. An opposite end 320 of the sliding swing arm 306 is slidably connected to a mid portion 322 of the stationary support 304 through a groove 324.

One end 326 of the pivoting swing arm 308 is pivotally attached to the a mid portion 328 of the fixed support 310. An opposite end 330 of the pivoting swing arm 308 is pivotally connected to an upper end 332 of the stationary support 304.

FIG. 15 shows a seat position with the re-orienting support 302 being moved in an upward direction 334. FIG. 16 shows the re-orienting support 302 being rotated in a forward direction 336 and the sliding swing arm 306 moved relative to the stationary support 304 along groove 324 so that the back cushion 312 is stored when in the bed position.

FIG. 17 shows the bed position with the stationary bed section 314 pivoted outward to form the bed surface 339, with inflated mattress 342 on top. The re-orienting support 302 allows for a higher back cushion 312 in the seat position and provides the desired foot height in the bed position.

The convertible seat 100 or 200 can be configured as a sofa in the seat position or it can be made narrower to be a love seat or chair. When configured as a sofa vs. a love seat or chair, the bed surface 126 or 226 will be wider than when in the bed position. The convertible seat 100 or 200 can also be configured and sized so that the user sleeps perpendicular to the support 112 or parallel to the support 112.

The mattress can be inflated using an electric pump and controlled via a remote control unit. Mattress 110, 212, and 342 also includes a conventional release valve to assist in quick deflation.

Features from the various embodiments described can be combined to configure new embodiments. For example, the slide folding mechanism 208 or the permanently attached seat cushion 205 of the second embodiment can be adapted to the first embodiment.

The invention can be used in motor homes, trailers, homes, offices, or other locations where both a seating and sleeping surface are needed. As can be seen from the numerous embodiments described above, various changes can be made to the invention without departing from the spirit thereof or scope of the following claims.

What is claimed is:

1. A convertible seat comprising:

a. a base, b. a folding frame including, i. a stationary bed section attached to the base, ii. a folding bed section pivotally attached to the stationary bed section which, in a first orientation, creates a seat position and which, in a second orientation creates a bed position, iii. a support extending from the folding bed section comprising a back support when the convertible seat is in the seat position and leg when the convertible seat is in the bed position, and c. a mattress cavity located between the folding bed section and stationary bed section when the convertible seat is in the seat position, the folding bed section and the stationary bed section forming a bed surface when the convertible seat is in the bed position.

2. The seat according to claim 1, including a hinge connecting the folding bed section and stationary bed section wherein the hinge includes perpendicular web sections to form the mattress cavity between the folding bed section and stationary bed section when the convertible seat is in the seat position.

3. The convertible seat of claim 2, wherein a mattress is positioned within the mattress cavity when the convertible seat is in the seat position, and atop the bed surface when the convertible seat is in the bed position.

4. The seat according to claim 3, wherein the mattress is an air mattress and the inflation of the air mattress assists the pivoting of the folding bed section.

5. A method of converting a seat to a bed comprising:

providing a convertible seat comprising:

a base, a folding frame including:

a stationary bed section attached to the base;

a folding bed section pivotally attached to the stationary bed section which, in a first orientation, creates a seat position and which, in a second orientation, creates a bed position;

a hinge pivotally attaching the folding bed section and stationary bed section wherein the hinge includes perpendicular web sections to form a mattress cavity between the folding bed section and stationary bed section when the convertible seat is in the seat position;

a support extending from the folding bed section comprising a back support when the convertible seat is in the seat position and leg when the convertible seat is in the bed position; and an air mattress positioned within the mattress cavity;

pivoting the folding bed section relative to the stationary bed section from the seat position to the bed position by inflating the air mattress located between the folding bed section and stationary bed section.

6. The method according to claim 5 further comprising the step of supporting the folding bed section as it pivots to resist an abrupt landing of the folding bed section upon reaching the bed position.

7. A convertible seat comprising:

a. a base, b. a folding frame including, i. a stationary bed section attached to the base, ii. a folding bed section pivotally attached to the stationary bed section which, in a first orientation, creates a seat position and which, in a second orientation creates a bed position, c. a mattress cavity located between the folding bed section and stationary bed section when the convertible seat is in the seat position, the folding bed section and the stationary bed section forming a bed surface when the convertible seat is in the bed position, and d. a hinge connecting the folding bed section and stationary bed section, the hinge including angled web sections to form the mattress cavity between the folding bed section and the stationary bed section when the convertible seat is in the seat position, the angled web sections generally extending toward one of the folding and stationary bed sections from a plane generally positioned centrally between a plane containing the stationary bed section and a plane containing the stationary bed section.

8. The seat according to claim 7, wherein a rotational axis of the hinge extends within the centrally positioned plane when the folding bed section is in the seat position.

9. The seat according to claim 7, wherein a mounting section extends outwardly from a side of each angled web section to connect the hinge to the folding bed section and the stationary bed section, where each mounting section connects to either the folding bed section or the stationary bed section.

10. The seat according to claim 9, wherein each mounting section extends from an end of the perpendicular web section to which it is attached.

11. The seat according to claim 7, wherein an extension generally extends between each angled web section and a portion of the hinge extending about the rotational axis of the hinge.

12. The seat according to claim 7, wherein the angled web sections extend in a direction perpendicular to the centrally positioned plane.

* * * * *